US006679818B2

(12) United States Patent
Hsien

(10) Patent No.: US 6,679,818 B2
(45) Date of Patent: Jan. 20, 2004

(54) APPARATUS FOR LOCKING THE TILTING ANGLE OF BODY INVERSION EXERCISE EQUIPMENT

(76) Inventor: Kuang-Wen Hsien, No. 64-2, Lungping Rd., Pingjen City, Taoyuan (TW)

( * ) Notice: Subject to any disclaimer, the term of this patent is extended or adjusted under 35 U.S.C. 154(b) by 72 days.

(21) Appl. No.: 10/079,617

(22) Filed: Feb. 22, 2002

(65) Prior Publication Data

US 2003/0162639 A1 Aug. 28, 2003

(51) Int. Cl.[7] ..... A63B 26/00
(52) U.S. Cl. ..... 482/144; 482/145; 482/907
(58) Field of Search ..... 482/143–145, 482/142, 148, 907, 908

(56) References Cited

U.S. PATENT DOCUMENTS 4,531,731 A * 7/1985 Law ..... 272/145
4,534,555 A * 8/1985 McGowen ..... 272/145

* cited by examiner

*Primary Examiner*—Nicholas D. Lucchesi
*Assistant Examiner*—L Amerson
(74) *Attorney, Agent, or Firm*—Browdy and Neimark, P.L.L.C.

(57) ABSTRACT

A body inversion exercise equipment comprises a base frame which has two connect boards at top end. A rotatable assembly has two connect bars pivoted to the connect boards of the base frame for free rotating. A holder assembly is disposed at the rotatable assembly for holding a user on the rotatable assembly, and two locking assemblies are disposed at the position between the connect boards and the connect bars by means of an axial rod passing through them. The locking assembly has an adjustment piece and a position piece. The adjustment piece is rotatable relative to the axial rod. The adjustment piece has a guiding slot, openings and an adjusting bar. The position piece connects to the rotatable assembly for rotating along with the rotatable assembly. The position piece has a pin can insert into one of the openings of the adjustment piece to lock the tilting angle of the rotatable assembly.

7 Claims, 6 Drawing Sheets

APPARATUS FOR LOCKING THE TILTING ANGLE OF BODY INVERSION EXERCISE EQUIPMENT

FIELD OF THE INVENTION

The present invention relates to an exercise equipment, and more particularly to an apparatus for locking the tilting angle of a body inversion exercise equipment.

BACKGROUND OF THE INVENTION

The conventional body training equipments, such as multi-functions training machine, treadmill, abdominal training device, are for training muscles and enhancing cardiopulmonary capacity of user. Another type of body training equipment, the body inversion exercise equipment, was designed for helping user standing upside down. In upside down status, the gravity will draw user's spine. So, the body inversion exercise equipment also has a function of helping healthy.

The body inversion exercise equipment has an ankle holder to secure user on the equipment. For the first time user who cannot control the tilting angle or simply just scared, he/she may tilt to the maximum angle of the machine suddenly. It might make the user refusing to use the machine again; furthermore, suddenly upside down may hurt the user.

SUMMARY OF THE INVENTION

The primary object of the present invention is to provide a body inversion exercise equipment, which can adjust and lock the titling angle of the inversion exercise equipment as user wants.

According to the object of the present invention, a body inversion exercise equipment comprises a base frame. A rotatable assembly is pivoted on the base frame for free rotating. A holder assembly is for holding a user on the rotatable assembly, and at least one locking assembly is disposed at the position of the rotatable assembly pivoting to the base frame. The locking assembly has an adjustment piece and a position piece. The adjustment piece is rotatable and has openings thereon. The position piece connects to the rotatable assembly for rotating along with the rotatable assembly. The position piece slidably disposes a pin thereon corresponding to the openings of the adjustment piece.

DETAILED DESCRIPTION OF THE INVENTION

Figure 1:
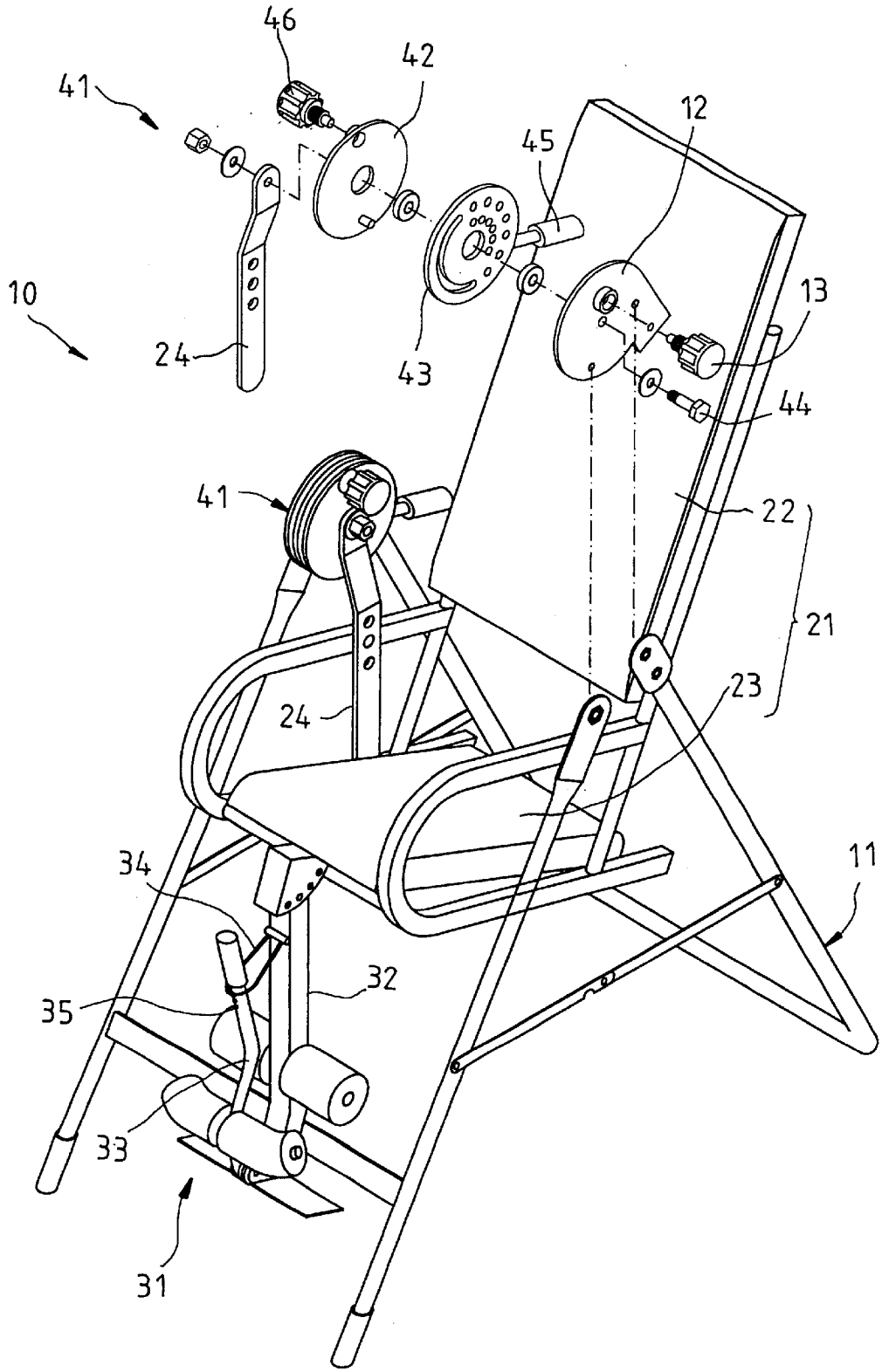
FIG. 1 is a perspective view of a prefer embodiment of the present invention, showing a locking assembly being to mount on the body inversion exercise equipment.
Figure 2:
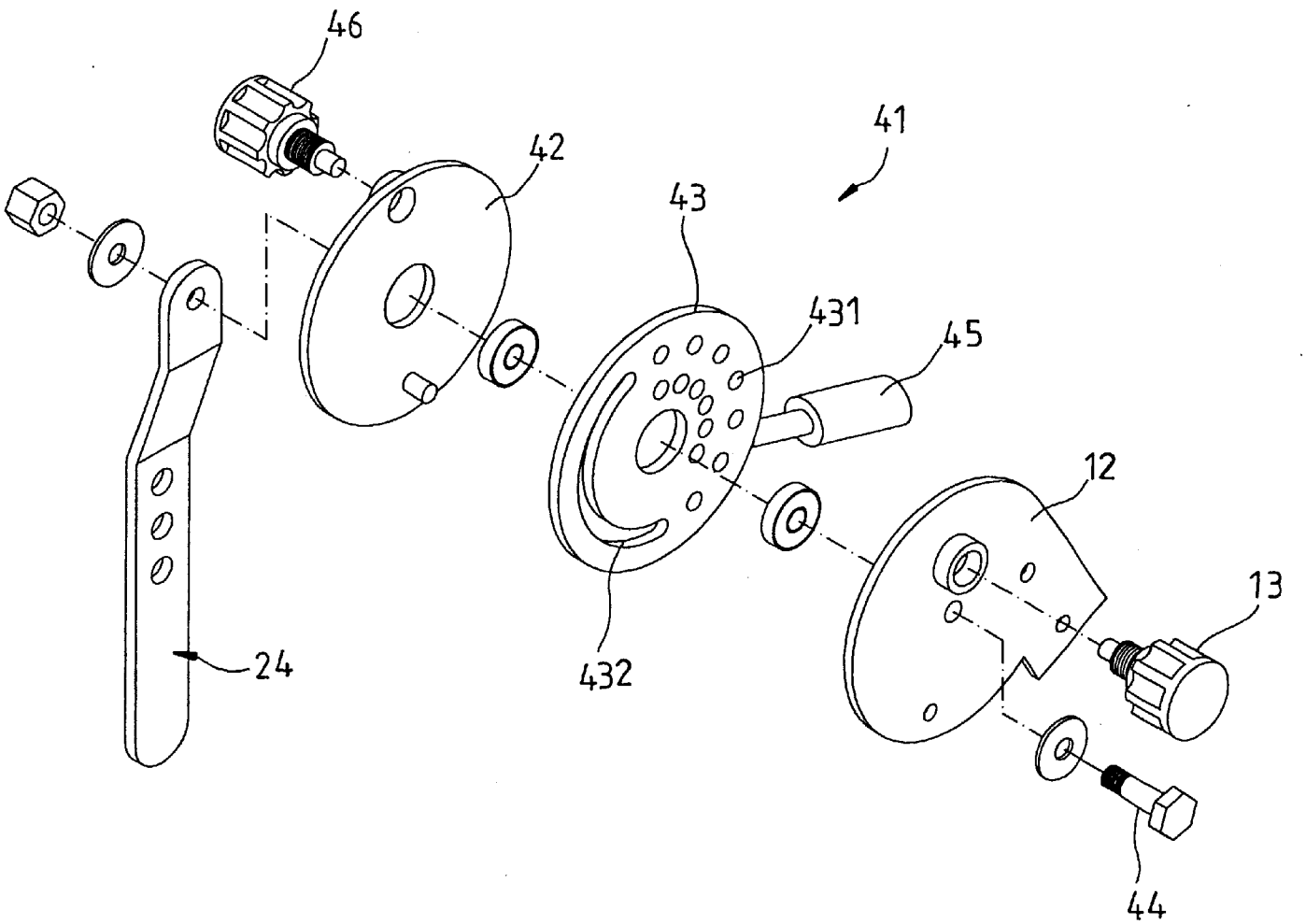
FIG. 2 is an exploded view of the locking assembly of the prefer embodiment of the present invention.

Please refer to FIG. 1 and FIG. 2, the prefer embodiment of the present invention provides a body inversion exercise equipment 10, which comprises a base frame 11, a rotatable assembly 21, a holder assembly 31 and two locking assembly 41.

The base frame 11 has two leg frames, which dispose two connect boards 12 at the top ends thereof respectively. Each of the connect boards 12 disposes a pin 13 respectively.

The rotatable assembly 21 has a seat pad 22 and a back pad 23. Two connect bars 24 have ends secured at the opposite sides of the seat pad 22 and the other ends pivoted at the connect boards 12 of the base frame 11, such that the rotatable assembly 21 can be turned relative to the base frame 11.

The holder assembly 31 has a main bar 32 and a pressing bar 33. The main bar 32 has an end thereof secured to the seat pad 22 of the rotatable assembly 21. A locking ring 34 is pivoted at the main bar 32. The pressing bar 33 has an end thereof pivoted at the distal end of the main bar 32 to be turned relative to the main bar 32. The pressing bar 32 has position blocks 35 thereon arranged as a line in equidistance. The locking ring 34 can be turned to position in between two of the position blocks 35 to secure the pressing bar 33, such that the pressing bar 33 can press user's ankles to secure user on the rotatable assembly 21.

Please refer to FIG. 2, the locking assemblies 41 are provided at between the connect boards 12 and the connect bars 24 respectively. Each of the locking assemblies 41 mainly has a position piece 42 and an adjustment piece 43. An axial rod 44 is to pass through the connect board 12, the adjustment piece 43, the position piece 42 and the connect bar 24 in sequence and to mesh with a nut. The adjustment piece 43 is rotatable relative to the connect board 12 and the position piece 42. The adjustment piece 43 has opening 431 and a semi-circular guiding slot 432 thereon. An adjusting bar 45 is disposed at the edge of the adjustment piece 43 for facilitating user to grip it to turn the adjustment piece 43. The position piece 42 is secured to the connect bar 24, such that the position piece 42 will be turned along with the connect bar 24. The position piece 42 has a pin 46. The pins 13 and 46 of the connect board 12 and the position piece 42 are corresponding to the opposite ends of the openings 431 of the adjustment piece 43.

Figure 3:
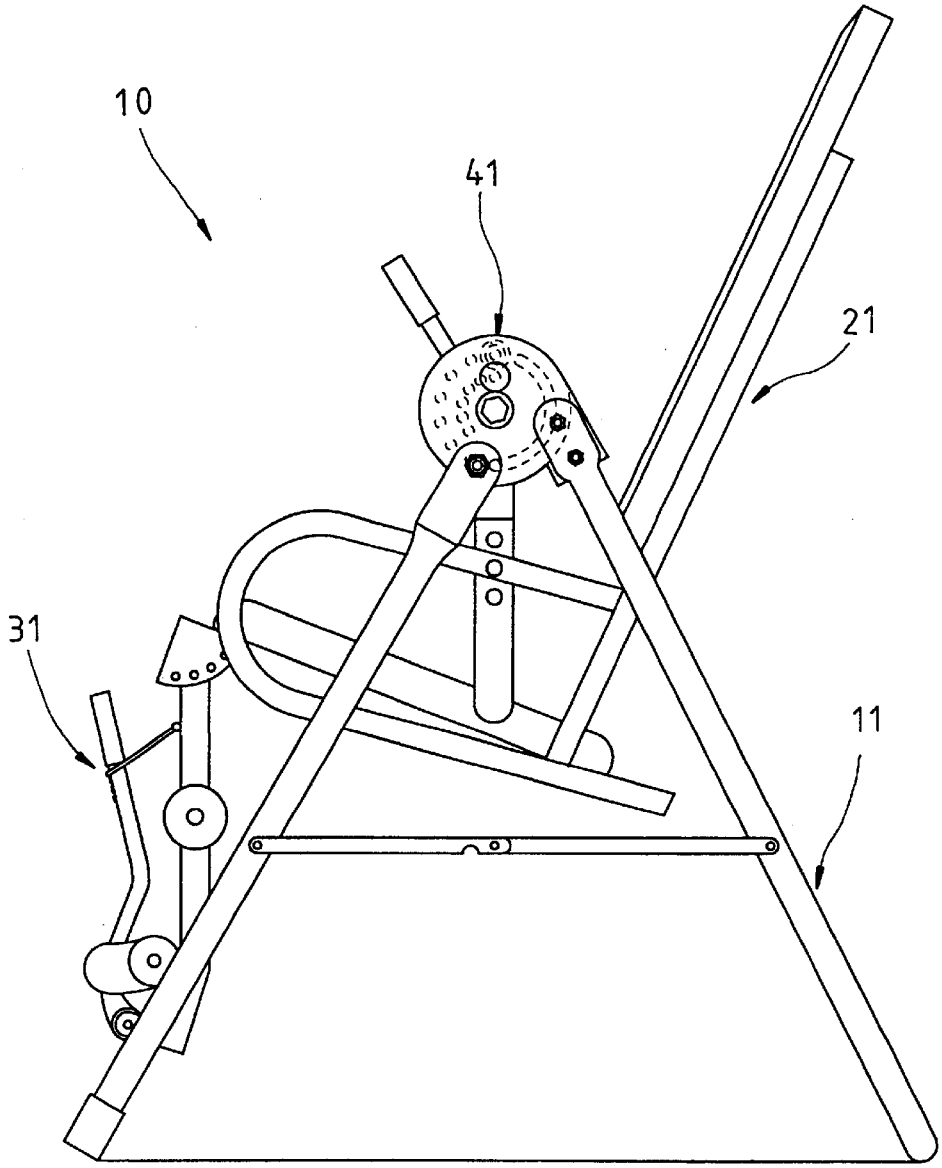
FIG. 3 is a perspective view of the present invention, showing the body inversion exercise equipment in the initial position.
Figure 4:
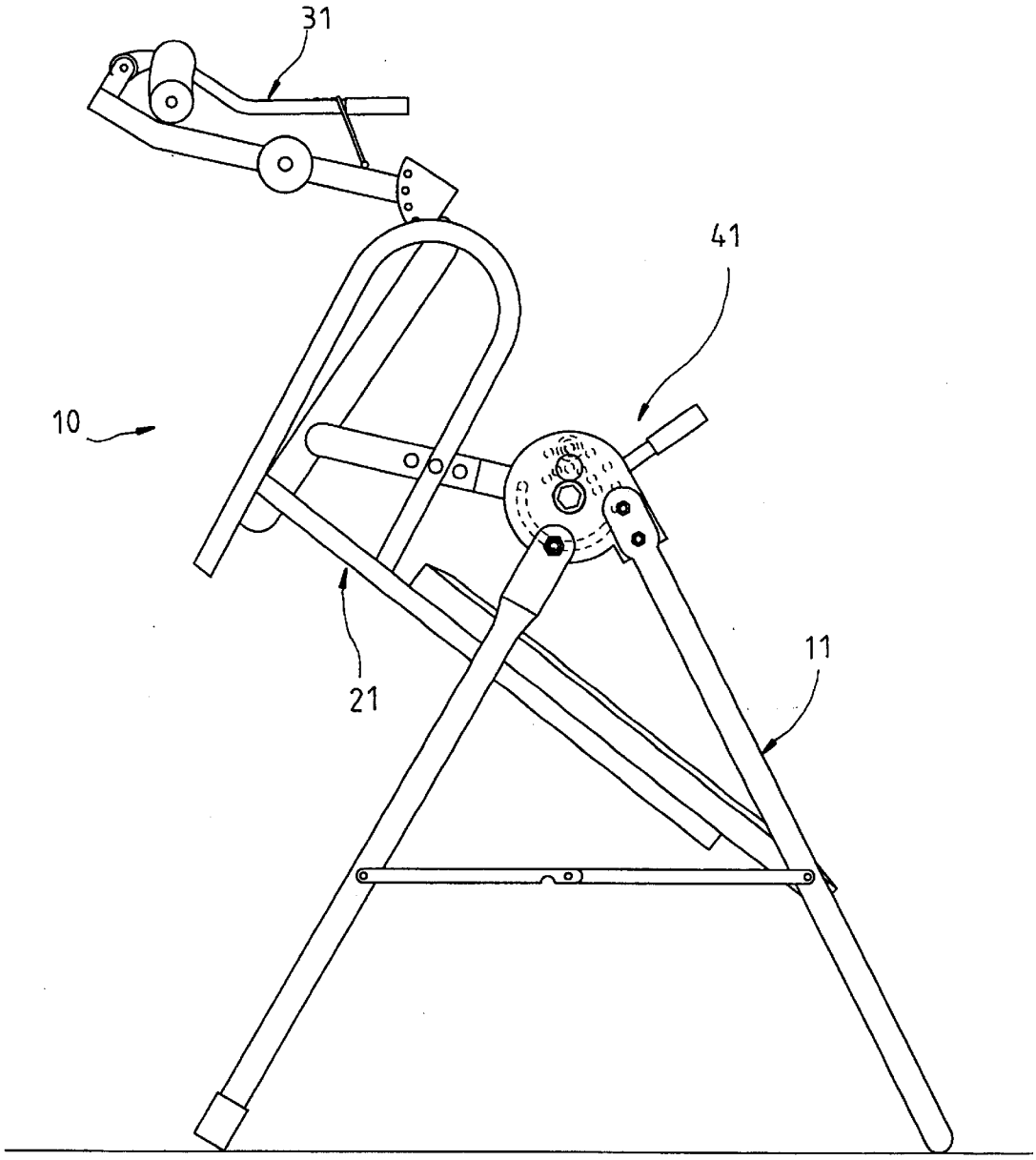
FIG. 4 is a perspective view of the present invention, showing body inversion exercise equipment tilting about 120 degrees.
Figure 5:
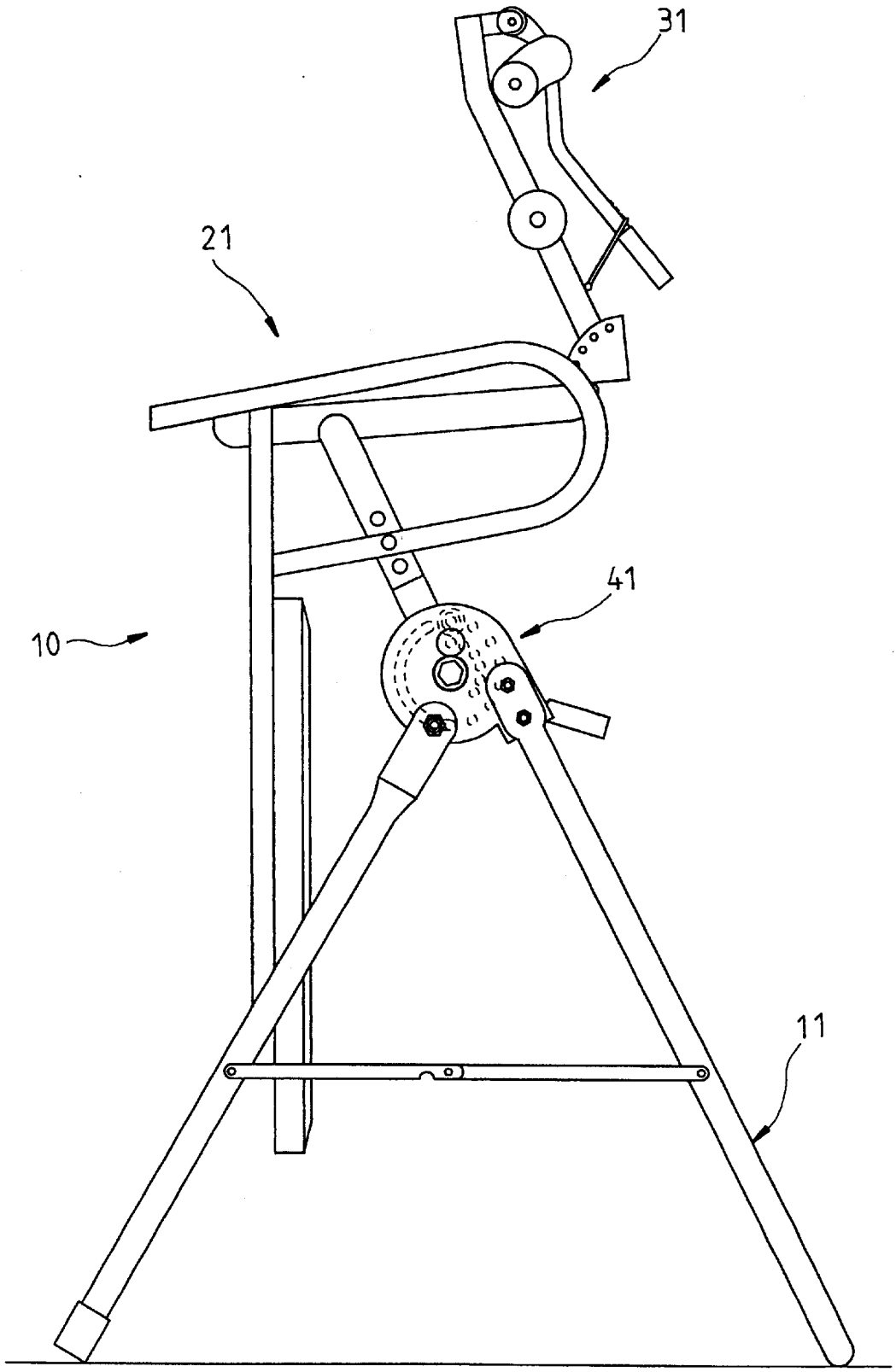
FIG. 5 is a perspective view of the present invention, showing body inversion exercise equipment tilting about 180 degrees.

Please refer to FIGS. from FIG. 3 to FIG. 5, when the rotatable assembly 21 is tilting, the connect bars 24 and the position piece 42 of the locking assembly 41 will be turned along with it. While user wants to stop tilting, he/she just needs to press the pins 13 and 46 of the connect board 12 and the position piece 42 to make the pins 46 respectively inserting into two of the openings 431 of the adjustment piece 43, such that the rotatable assembly 21 will be secured at the present tilting angle.

Furthermore, user can grip the adjusting bar 45 to turn the adjustment piece 43 for the openings 431 thereon locating at different angle range. Thus, please compare to the FIG. 4 and FIG. 5, the ranges of the tilting angle of the rotatable assembly 21, where the locking assembly 41 can lock the rotatable assembly 21, can be chosen by user.

Figure 6:
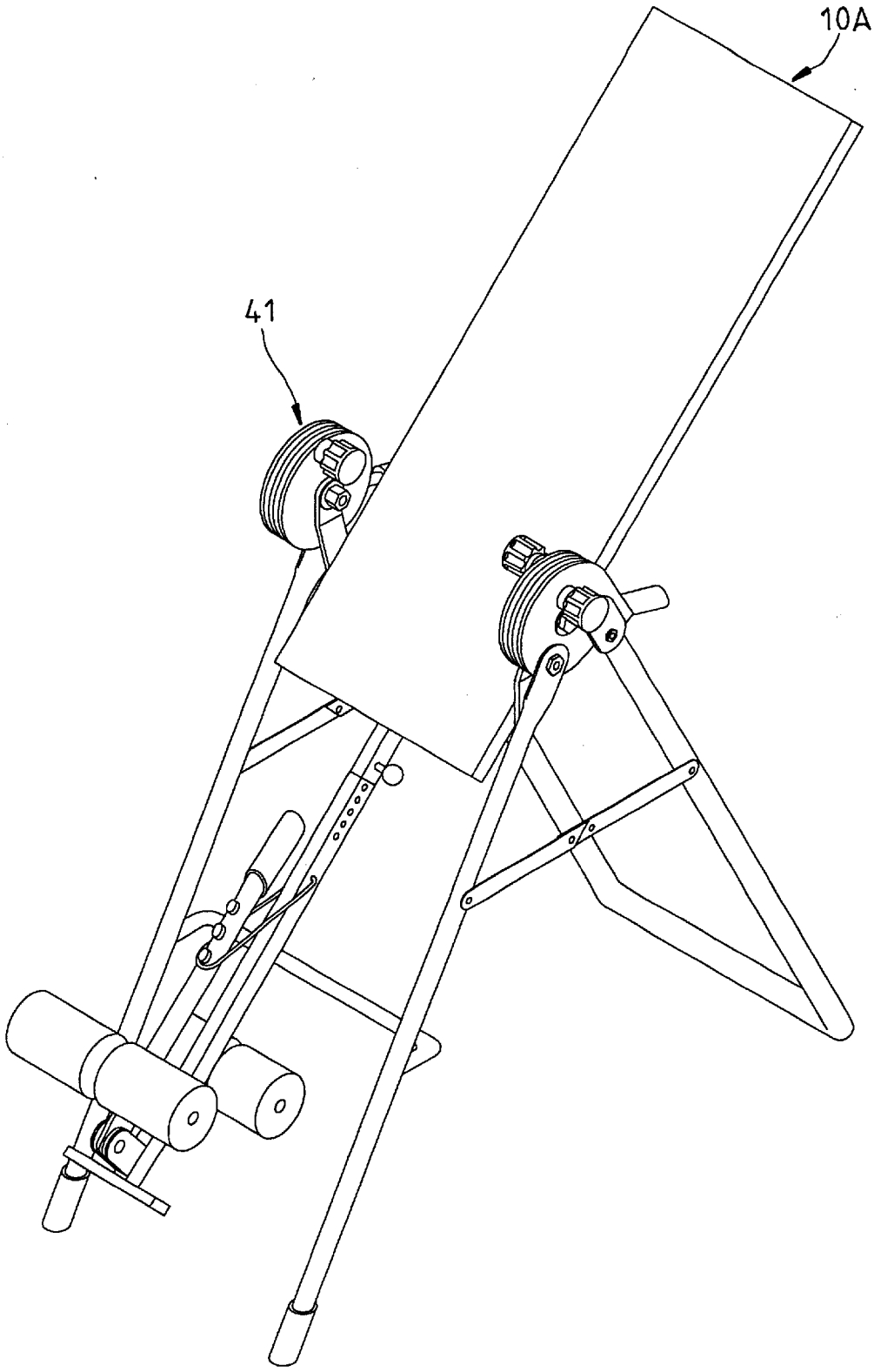
FIG. 6 is a perspective view, showing the locking assembly of the present invention mounted on another type of body inversion exercise equipment.

FIG. 6 shows the locking assembly 41 of the present invention is disposed at a conventional body inversion exercise equipment 10A, which provide the conventional body inversion exercise equipment having the locking functions of the present invention as described above.

What is claimed is:

1. A body inversion exercise equipment, comprising:

a base frame;

a rotatable assembly pivoted on said base frame for free rotating relative to said base frame;

a holder assembly disposed at said rotatable assembly for holding a user on said rotatable assembly, at least one locking assembly disposed at the position of said rotatable assembly pivoting to said base frame; said locking assembly having an adjustment piece and a position piece; said adjustment piece being rotatable relative to said rotatable assembly; said adjustment piece having openings thereon; said position piece connecting to said rotatable assembly for rotating along with said rotatable assembly; said position piece slidably disposing a pin thereon corresponding to said openings of said adjustment piece; and wherein said base frame has two leg frames and two connect boards disposed at the top ends of said leg frames respectively, each of said connect board slidably disposing a pin.

2. The body inversion exercise equipment as defined in claim 1, wherein said adjustment piece further has a curved guiding slot thereon, and the openings are arranged in equidistance.

3. The body inversion exercise equipment as defined in claim 1, wherein said rotatable assembly has two connect bars, which has ends fastening to the opposite sides of said rotatable assembly respectively, and the other ends thereof pivoted at said base frame.

4. A body inversion exercise equipment, comprising:

a base frame;

a rotatable assembly pivoted on said base frame for free rotating relative to said base frame;

a holder assembly disposed at said rotatable assembly for holding a user on said rotatable assembly, at least one locking assembly disposed at the position of said rotatable assembly pivoting to said base frame; said locking assembly having an adjustment piece and a position piece; said adjustment piece being rotatable relative to said rotatable assembly; said adjustment piece having openings thereon; said position piece connecting to said rotatable assembly for rotating along with said rotatable assembly; said position piece slidably disposing a pin thereon corresponding to said openings of said adjustment piece, wherein said adjustment piece further has an adjusting bar thereon.

5. The body inversion exercise equipment as defined in claim 4, wherein said base frame has two leg frames and two connect boards disposed at the top ends of said leg frames respectively, each of said connect board slidably disposing a pin.

6. The body inversion exercise equipment as defined in claim 4, wherein said adjustment piece further has a curved guiding slot thereon, and the openings are arranged in equidistance.

7. The body inversion exercise equipment as defined in claim 4, wherein said rotatable assembly has two connect bars, which has ends fastening to the opposite sides of said rotatable assembly respectively, and the other ends thereof pivoted at said base frame.

* * * * *